US006504489B1

(12) United States Patent
Westfield et al.

(10) Patent No.: US 6,504,489 B1
(45) Date of Patent: Jan. 7, 2003

(54) PROCESS CONTROL TRANSMITTER HAVING AN EXTERNALLY ACCESSIBLE DC CIRCUIT COMMON

(75) Inventors: Brian L. Westfield, Victoria, MN (US); Weston Roper, St. Louis Park, MN (US); Richard L. Nelson, Chanhassen, MN (US)

(73) Assignee: Rosemount Inc., Eden Prairie, MN (US)

( * ) Notice: Subject to any disclaimer, the term of this patent is extended or adjusted under 35 U.S.C. 154(b) by 0 days.

(21) Appl. No.: 09/571,111

(22) Filed: May 15, 2000

(51) Int. Cl.[7] ..... G08C 19/00

(52) U.S. Cl. ..... 340/870.3; 702/57; 702/85; 702/104; 702/116

(58) Field of Search ..... 340/870.3, 870.37, 340/870.39, 870.16, 501, 531; 73/700, 706; 702/62, 57, 116, 104, 85

(56) References Cited

U.S. PATENT DOCUMENTS

| | | | |
|---|---|---|---|
| 3,701,280 A | 10/1972 | Stroman | 73/194 |
| 3,968,694 A | 7/1976 | Clark | 73/398 |

(List continued on next page.)

FOREIGN PATENT DOCUMENTS

| | | |
|---|---|---|
| DE | 37 41 648 A1 | 7/1988 |
| DE | 91 09 176 | 10/1991 |
| DE | 197 45 244 A1 | 4/1998 |
| DE | 299 03 260 U1 | 5/2000 |
| EP | 0 063 685 A1 | 11/1982 |
| EP | 0 214 801 A1 | 3/1987 |
| EP | 0 223 300 A2 | 5/1987 |
| EP | 0 268 742 A1 | 7/1987 |
| EP | 0 639 039 A1 | 2/1995 |
| EP | 0 903 651 A1 | 3/1999 |
| JP | 401313038 A | 12/1989 |
| JP | 2000121470 | 10/1998 |
| WO | WO 88/01417 | 2/1988 |
| WO | WO 89/02578 | 3/1989 |
| WO | WO 89/04089 | 5/1989 |
| WO | WO 90/15975 | 12/1990 |
| WO | WO 91/18266 | 11/1991 |
| WO | WO 96/34264 | 10/1996 |
| WO | WO 98/48489 | 10/1998 |
| WO | WO 00/23776 | 4/2000 |

OTHER PUBLICATIONS

U.S. patent application Ser. No. 09/671,495, Behm et al., filed Sep. 27, 2000.

U.S. patent application Ser. No. 09/519,781, Neslon et al., filed Mar. 7, 2000.

U.S. patent application Ser. No. 09/520,292, Davis et al., filed Mar. 7, 2000.

U.S. patent application Ser. No. 09/519,912, Nelson et al., filed Mar. 7, 2000.

(List continued on next page.)

*Primary Examiner*—Michael Horabik
*Assistant Examiner*—Albert K. Wong
(74) *Attorney, Agent, or Firm*—Westman, Champlin & Kelly

(57) ABSTRACT

Disclosed is a process control transmitter having an externally accessible DC circuit common that eliminates the need to perform level shifting of signals communicated between the transmitter and external processing electronics. The process control transmitter includes first, second and third terminals which feedthrough a housing. Circuitry contained in the housing is coupled to the first, second and third terminals and is adapted to communicate information to external processing electronics through the second and third terminals using a digital signal that is regulated relative to a DC common that is coupled to the second terminal. External processing electronics can couple to the second and third terminals and interpret the digital signal without having to perform level-shifting adjustments.

27 Claims, 10 Drawing Sheets

U.S. PATENT DOCUMENTS 4,120,206 A 10/1978 Rud, Jr. ..... 73/718
4,125,027 A 11/1978 Clark ..... 73/724
4,238,825 A 12/1980 Geery ..... 364/510
4,250,490 A 2/1981 Dahlke ..... 340/870.37
4,287,501 A 9/1981 Tominaga et al. ..... 338/42
4,414,634 A 11/1983 Louis et al. ..... 364/510
4,419,898 A 12/1983 Zanker et al. ..... 73/861.02
4,446,730 A 5/1984 Smith ..... 73/301
4,455,875 A 6/1984 Guimard et al. ..... 73/708
4,485,673 A 12/1984 Stern ..... 73/304
4,528,855 A 7/1985 Singh ..... 73/721
4,562,744 A 1/1986 Hall et al. ..... 73/861.02
4,598,381 A 7/1986 Cucci ..... 364/558
4,602,344 A 7/1986 Ferretti et al. ..... 364/509
4,617,607 A 10/1986 Park et al. ..... 361/283.4
D287,827 S 1/1987 Broden ..... D10/46
4,644,797 A 2/1987 Ichikawa et al. ..... 73/706
4,653,330 A 3/1987 Hedtke ..... 73/756
4,677,841 A 7/1987 Kennedy ..... 73/30
4,745,810 A 5/1988 Pierce et al. ..... 73/706
D296,995 S 8/1988 Lee ..... D10/46
D297,314 S 8/1988 Hedtke ..... D10/46
D297,315 S 8/1988 Pierce et al. ..... D10/85
4,783,659 A 11/1988 Frick ..... 340/870.37
4,798,089 A 1/1989 Frick et al. ..... 73/706
4,818,994 A 4/1989 Orth et al. ..... 340/870.21
4,825,704 A 5/1989 Aoshima et al. ..... 73/861.42
4,833,922 A 5/1989 Frick et al. ..... 73/756
4,850,227 A 7/1989 Luettgen et al. ..... 73/708
4,866,989 A 9/1989 Lawless ..... 73/756
4,881,412 A 11/1989 Northedge ..... 73/861.04
4,930,353 A 6/1990 Kato et al. ..... 73/727
4,958,938 A 9/1990 Schwartz et al. ..... 374/208
4,970,898 A 11/1990 Walish et al. ..... 73/706
4,980,675 A 12/1990 Meisenheimer, Jr. ..... 340/626
5,000,047 A 3/1991 Kato et al. ..... 73/706
D317,266 S 6/1991 Broden et al. ..... D10/46
D317,269 S 6/1991 Selg ..... D10/52
D318,432 S 7/1991 Broden et al. ..... D10/46
5,028,746 A 7/1991 Petrich ..... 191/12.2 R
5,035,140 A 7/1991 Daniels et al. ..... 73/290
5,051,937 A 9/1991 Kawate et al. ..... 702/104
5,058,437 A 10/1991 Chaumont et al. ..... 73/861.21
5,060,108 A 10/1991 Baker et al. ..... 361/283
5,070,732 A 12/1991 Duncan et al. ..... 73/431
5,087,871 A 2/1992 Losel ..... 323/299
5,094,109 A 3/1992 Dean et al. ..... 73/718
D329,619 S 9/1992 Cartwright ..... D10/52
5,142,914 A 9/1992 Kusakabe et al. ..... 73/723
5,157,972 A 10/1992 Broden et al. ..... 73/718
5,162,725 A 11/1992 Hodson et al. ..... 324/115
5,187,474 A 2/1993 Kielb et al. ..... 340/870.18
5,212,645 A 5/1993 Wildes et al. ..... 700/108
5,227,782 A 7/1993 Nelson ..... 340/870.11
5,236,202 A 8/1993 Krouth et al. ..... 277/164
5,245,333 A 9/1993 Anderson et al. ..... 340/870.3
5,248,167 A 9/1993 Petrich et al. ..... 285/23
D342,456 S 12/1993 Miller et al. ..... D10/60
5,276,631 A 1/1994 Popovic et al. ..... 702/104
5,287,746 A 2/1994 Broden ..... 73/706
5,353,200 A 10/1994 Bodin et al. ..... 361/816
5,369,386 A 11/1994 Alden et al. ..... 335/206
5,377,547 A 1/1995 Kusakabe et al. ..... 73/723
5,381,355 A 1/1995 Birangi et al. ..... 364/724.01
D358,784 S 5/1995 Templin, Jr. et al. ..... D10/96
5,436,824 A 7/1995 Royner et al. ..... 363/89
5,448,180 A 9/1995 Kienzler et al. ..... 326/15
5,469,150 A 11/1995 Sitte ..... 340/3.42
5,471,885 A 12/1995 Wagner ..... 73/862.041
D366,000 S 1/1996 Karas et al. ..... D10/60
D366,218 S 1/1996 Price et al. ..... D10/52
5,495,768 A 3/1996 Louwagie et al. ..... 73/706
5,498,079 A 3/1996 Price ..... 374/208
5,502,659 A 3/1996 Braster et al. ..... 702/104
5,515,038 A * 5/1996 Smith ..... 340/853.1
5,524,333 A 6/1996 Hogue et al. ..... 29/593
5,524,492 A 6/1996 Frick et al. ..... 73/706
5,546,804 A 8/1996 Johnson et al. ..... 73/431
5,600,782 A 2/1997 Thomson ..... 395/182.02
5,606,513 A 2/1997 Louwagie et al. ..... 364/510
5,650,936 A 7/1997 Loucks et al. ..... 702/62
5,656,782 A 8/1997 Powell, II et al. ..... 73/756
5,665,899 A 9/1997 Willcox ..... 73/1.63
5,668,322 A 9/1997 Broden ..... 73/756
5,669,713 A 9/1997 Schwartz et al. ..... 374/1
5,670,722 A 9/1997 Moser et al. ..... 73/756
5,677,476 A 10/1997 McCarthy et al. ..... 73/29.01
5,710,552 A 1/1998 McCoy et al. ..... 340/870.21
5,754,596 A 5/1998 Bischoff et al. ..... 375/295
5,764,928 A 6/1998 Lancott ..... 395/285
5,823,228 A 10/1998 Chou ..... 137/597
5,870,695 A 2/1999 Brown et al. ..... 702/138
5,899,962 A 5/1999 Louwagie et al. ..... 702/138
5,920,016 A 7/1999 Broden ..... 73/756
5,948,988 A 9/1999 Bodin ..... 73/706
5,954,526 A 9/1999 Smith ..... 439/136
5,955,685 A 9/1999 Gravel et al. ..... 73/866.5
5,973,942 A 10/1999 Nelson et al. ..... 363/21
5,983,727 A 11/1999 Wellman et al. ..... 73/724
5,988,203 A 11/1999 Hutton ..... 137/597
6,006,338 A 12/1999 Longdorf et al. ..... 713/340
6,038,927 A 3/2000 Karas ..... 73/706
6,050,145 A 4/2000 Olson et al. ..... 73/706
6,059,254 A 5/2000 Sundet et al. ..... 248/678
6,105,437 A 8/2000 Klug et al. ..... 73/756
6,111,888 A 8/2000 Green et al. ..... 370/461
6,115,831 A 9/2000 Hanf et al. ..... 714/43
6,123,585 A 9/2000 Hussong et al. ..... 439/652
6,131,467 A 10/2000 Miyano et al. ..... 73/756
6,140,952 A 10/2000 Gaboury ..... 341/143
6,151,557 A 11/2000 Broden et al. ..... 702/47
6,216,172 B1 4/2001 Kolblin et al. ..... 709/253
6,233,532 B1 5/2001 Bourdreau et al. ..... 702/89
6,285,964 B1 9/2001 Babel et al. ..... 702/121
6,295,875 B1 10/2001 Frick et al. ..... 73/718
6,311,568 B1 11/2001 Kleven ..... 73/861.42
6,321,166 B1 11/2001 Evans et al. ..... 702/50

OTHER PUBLICATIONS

U.S. patent application Ser. No. 09/672,338, Nelson et al., filed Sep. 28, 2000.
U.S. patent application Ser. No. 09/638,181, Roper et al., filed Jul. 31, 2000.
U.S. patent application Ser. No. 09/571,111, Westfield et al., filed May 15, 2000.
U.S. patent application Ser. No. 09/564,506, Nord et al., filed May 4, 2000.
U.S. patent application Ser. No. 09/667,289, Westfield et al., filed Sep. 22, 2000.
U.S. patent application Ser. No. 09/667,399, Behm et al., filed Sep. 21, 2000.
U.S. patent application Ser. No. 09/671,130, Fandrey et al., filed Sep. 27, 2000.
U.S. patent application Ser. No. 29/120,531, Fandrey et al., filed Mar. 21, 2000.
U.S. patent application Ser. No. 29/120,544, Fandrey et al., filed Mar. 21, 2000.
U.S. patent application Ser. No. 29/120,538, Fandrey et al., filed Mar. 21, 2000.

U.S. patent application Ser. No. 29/120,522, Fandrey et al., filed Mar. 21, 2000.

U.S. patent application Ser. No. 29/120,537, Fandrey et al., filed Mar. 21, 2000.

U.S. patent application Ser. No. 29/120,553, Fandrey et al., filed Mar. 21, 2000.

Product Data Sheet No.: 00813–0100–4378, "Model 751 Field Signal Indicator", by Rosemount Inc., Eden Prairie, Minnesota, (1997).

Product Data Sheet No.: 00813–0100–4731, "APEX™ Radar Gauge", by Rosemount Inc., Eden Prairie, Minnesota, (1998).

Product Data Sheet No.: 00813–0100–4640, "Model 3201 Hydrostatic Interface Unit", from the Rosemount Comprehensive Product Catalog, published 1998, by Rosemount Inc., Eden Prairie, Minnesota.

Product Data Sheet No.: 00813–0100–4003, "Model 8800A", by Rosemount Inc., Eden Prairie, Minnesota, (1998).

Product Data Sheet No.: 00813–0100–4773, "Model 8742C—Magnetic Flowmeter Transmitter with Foundation™ Fieldbus", from the Rosemount Comprehensive Product Catalog, published 1998, by Rosemount Inc., Eden Prairie, Minnesota.

"Rosemount Model 8732C Magnetic Flowmeter Transmitter", by Rosemount Inc., Eden Prairie, Minnesota, (1998).

Product Data Sheet No.: 00813–0100–4263, "Model 444 Alphaline® Temperature Transmitters", by Rosemount Inc., Eden Prairie, Minnesota, (1997).

Product Data Sheet No.: 00813–0100–4769, "Model 3244MV Multivariable Temperature Transmitter with Foundation™ Fieldbus", by Rosemount Inc., Eden Prairie, Minnesota, (1998).

Product Data Sheet No.: 00813–0100–4724, "Models 3144 and 3244MV Smart Temperature Transmitters", by Rosemount Inc., Eden Prairie, Minnesota, (1998).

Product Data Sheet No.: 00813–0100–4738, "Model 3095FB Multivariable™ Transmitter with Modbus™ Protocol", by Rosemount Inc., Eden Prairie, Minnesota, (1996, 1997).

Product Data Sheet No.: 00813–0100–4001, "Model 3051 Digital Pressure Transmitter for Pressure, Flow, and Level Measurement", by Rosemount Inc., Eden Prairie, Minnesota, (1998).

Product Data Sheet No.: 00813–0100–4698, "Model 2090F Sanitary Pressure Transmitter", by Rosemount Inc., Eden Prairie, Minnesota, (1998).

Product Data Sheet No.: 00813–0100–4690, "Model 2088 Economical Smart Pressure Transmitter", by Rosemount Inc., Eden Prairie, Minnesota, (1998).

Product Data Sheet No.: 00813–0100–4592, "Model 2024 Differential Pressure Transmitter", by Rosemount Inc., Eden Prairie, Minnesota, (1987–1995).

Product Data Sheet No.: 00813–0100–4360, "Model 1151 Alphaline® Pressure Transmitters", by Rosemount Inc., Eden Prairie, Minnesota, (1998).

Product Data Sheet No.: 00813–0100–4458, "Model 1135F Pressure–to–Current Converter", by Rosemount Inc., Eden Prairie, Minnesota, (1983, 1986, 1994).

"Single Chip Senses Pressure and Temperature," *Machine Design*, 64 (1992) May 21, No. 10.

Brochure: "Reduce Unaccounted–For Natural Gas with High–Accuracy Pressure Transmitters," Rosemount Inc. Measurement Division, Eden Prairie, Minnesota, ADS 3073, 5/91, pp. 1–4.

Technical Information Bulletin, "Liquid Level Tansmitter Model DB40RL Sanitary Sensor deltapilot," Endress + Hauser, Greenwood, Indiana, 9/92, pp. 1–8.

"The Digitisation of Field Instruments" W. Van Der Bijl, *Journal A*, vol. 32, No. 3, 1991, pp. 62–65.

Specification Summary, "TELETRANS™ 3508–30A Smart Differential Pressure Transmitter," (undated) Bristol Babcock, Inc., Watertown, CT, 06795.

Specification Summary, "TELETRANS™ 3508–10A Smart Pressure Transmitter," (undated) Bristol Babcock, Inc., Watertown, CT, 06795.

Specification Summary, "AccuRate Advanced Gas Flow Computer, Model GFC 3308," (undated) Bristol Babcock, Inc., Watertown, CT, 06795.

Product Data Sheet PDS 4640, "Model 3201 Hydrostatic Interface Unit," Mar. 1992, Rosemount Inc., Eden Prairie, MN 55344.

Product Data Sheet PDS 4638, "Model 3001CL Flush–Mount Hydrostatic Pressure Transmitter," Jul. 1992, Rosemount Inc., Eden Prairie, MN 55344.

"Flow Measurement," *Handbook of Fluid Dynamics*, V. Streeter, Editor–in–chief, published by McGraw–Hill Book Company, Inc. 1961, pp. 14–4 to 14–15.

"Precise Computerized In–Line Compressible Flow Metering," *Flow—Its Measurement and Control in Science and Industry*, vol. 1, Part 2, Edited by R. Wendt, Jr., Published by American Institute of Physics et al, (undated) pp. 539–540.

"A Systems Approach," Dr. C. Ikoku, *Natural Gas Engineering*, PennWell Books, (undated) pp. 256–257.

"Methods for Volume Measurement Using Tank–Gauging Devices Can Be Error Prone," F. Berto, *The Advantages of Hydrostatic Tank Gauging Systems*, undated reprint from *Oil & Gas Journal*.

"Hydrostatic Tank Gauging—Technology Whose Time Has Come," J. Berto, *Rosemount Measurement Division Product Feature*, undated reprint from *INTECH*.

"Pressure Sensors Gauge Tank Level and Fluid Density," *Rosemount Measurement Division Product Feature*, undated reprint from *Prepared Foods* (Copyrighted 1991 by Gorman Publishing Company).

"Low Cost Electronic Flow Measurement System," *Tech Profile*, May 1993, Gas Research Institute, Chicago, IL.

"Development of an Integrated EFM Device for Orifice Meter Custody Transfer Applications," S.D. Nieberle et al., *American Gas Association Distribution/Transmission Conference & Exhibit*, May 19, 1993.

Advertisement, AccuRate Model 3308 Integral Smart DP/P/T Transmitter, (undated) Bristol Babcock, Inc., Watertown, CT 06795.

Advertisement, Model 3508 DP Transmitter, *Control Engineering*, Dec. 1992, Bristol Babcock, Inc., Watertown, CT 06795.

"Smart Transmitters Tear Up The Market," C. Polsonetti, *INTECH*, Jul. 1993, pp. 42–45.

"MicroLAN Design Guide", Dallas Semiconductor, Tech Brief No. 1, (undated).

"Bosch CAN Specification Version 2.0", by Robert Bosch GmbH, pp. 1–68 including pp. –1–and –2–, (Sep. 1991).

Product Data Sheet No. 00813–0100–4001, "Digital Pressure Transmitter for Pressure, Flow, and Level Measurement", by Rosemount Inc., (1998).
"Claudius Ptolemy (100?–170? AD)", *M&C News*, 7 pages, (Apr. 1994).
American National Standard, "Hydraulic Fluid Power–Solenoid Piloted Industrial Valves–Interface Dimensions for Electrical Connectors", National Fluid Power Association, Inc., 10 pages, (Aug. 1981).
2 pages downloaded from http://www.interlinkbt.com/PRODUCT/IBT_PROD/DN/CN–$DM_{13}$PN/EURO–D-P.HTM dated Sep. 15, 2000.
4 pages downloaded from http://www.interlinkbt.com/PRODUCT/IBT_PROD/dn/EUR–CON/euro–fwc.htm dated Sep. 15, 2000.
3 pages from TURK Cable Standards, by Turk, Inc., Minneapolis, Minnesota.
U.S. patent application Ser. No. 09/862,762, filed May 21, 2001, entitled "Sigma–Delta Analog to Digital Converter for Process Transmitter".
U.S. patent application Ser. No. 09/867,961, filed May 30, 2001, entitled "Environmentally Sealed Service Block".
Form PCT/ISA/220 (3 pages) and Form PCT/ISA/210 (3 pages) from the International Searching Authority of the European Patent Office, relating to International Application No. PCT/US 01/13993, date of mailing Nov. 22, 2001.

* cited by examiner

LOAD 2
LOAD 1
REGULATOR 2
REGULATOR 1
FEEDBACK NETWORK 1
FEEDBACK NETWORK 2
OUTPUT STAGE
CURRENT REGULATOR
SENSOR SIGNAL
AC NODE
DC NODE
AC
DC
CIRCUIT COMMON
RS2 SENSE RESISTOR
62
62A
62B
44
44A
44B
82
80
70
60
78
76
74
72
124
126
128
130
116
114
108
106
105
102
120
122
118
110
112
32
38
40
36
84
136
66
64

PROCESS CONTROL TRANSMITTER HAVING AN EXTERNALLY ACCESSIBLE DC CIRCUIT COMMON

BACKGROUND OF THE INVENTION

The present invention relates to process control transmitters used to measure process variables in industrial processing plants. More particularly, the present invention relates to a process control transmitter having an externally accessible DC circuit common.

Process control transmitters are used in industrial processing plants to monitor process variables and control industrial processes. Process control transmitters are generally remotely located from a control room and are coupled to process control circuitry in the control room by a process control loop. The process control loop can be a 4–20 mA current loop that powers the process control transmitter and provides a communication link between the process control transmitter and the process control circuitry. Typically, the transmitter senses a characteristic or process variable, such as pressure, temperature, flow, pH, turbidity, level, or the process variables, and transmits an output that is proportional to the process variable being sensed to a remote location over a plant communication bus. The plant communication bus can use a 4–20 mA analog current loop or a digitally encoded serial protocol such as HART® or FOUNDATION™ fieldbus protocols, for example.

Referring now to FIG. 1, a simplified block diagram of a process control transmitter as can be found in the prior art is shown. Here, process control transmitter 10 includes housing 12, circuitry 14, and first and second terminals 16A and 16B. Housing 12 is not permanently hermetically sealed and generally includes lower housing member 12A and removable cap 12B. A seal (not shown) is typically sandwiched between lower housing member 12A and cap 12B to seal housing 12. Process control loop 18 can couple process control transmitter 10 to control room 20 at first and second terminals 16A and 16B. Circuitry 14 is configured to receive a sensor input 22 relating to a process variable and communicate the process variable information to control room 20 over process control loop 18.

Circuitry 14 generally communicates with control room 20 over process control loop 18 by adjusting loop current $I_T$ flowing through process control loop 18 and first and second terminal 16A and 16B. Circuitry 14 senses loop current $I_T$ with feedback output FB, which relates to the voltage at node 24 with respect to DC common 26 or the voltage drop across sense resistor $R_{SENSE}$. Feedback output FB is communicated to circuitry 14 through conductor 28 which includes series resistor $R_{SERIES}$ which allows a negligible amount of current to flow through conductor 28 between node 24 and circuitry 14. Circuitry 14 uses feedback output FB to adjust loop current $I_T$ in accordance with the sensor input 22.

The voltage drop across sense resistor $R_{SENSE}$, second terminal 16B has a voltage that is offset from DC circuit common 26 by the voltage drop across $R_{SENSE}$. Additionally, the voltage difference between second terminal 16B and DC circuit common 26 will vary as loop current $I_T$ is varied by circuitry 14. As a result, communication signals produced by circuitry 14, which are regulated with respect to DC circuit common 26, cannot be conveniently communicated to processing circuitry that is external to process control transmitter 10 without performing a level shift in the voltage of the communication signals to compensate for the voltage drop across sense resistor $R_{SENSE}$. This level-shifting requirement would result in increased cost and complexity of processing electronics that are to be coupled to transmitter 10 and adapted to communicate with circuitry 14 using signals which are regulated with respect to DC circuit common 26. Additionally, there is an increase in the potential for error due to mismatched level-shifting or DC circuit common.

SUMMARY OF THE INVENTION

A process control transmitter having an externally accessible DC circuit common is provided that eliminates the need to perform level shifting of signals communicated between the transmitter and external processing electronics. The process control transmitter includes first, second and third externally accessible terminals, a series regulator, circuitry, a shunt, and a shunt current regulator. The first and second terminals are coupleable to a process control loop and are adapted to conduct a loop current through the transmitter. The circuitry is energized by a load current and is generally adapted to manage process variable and transmitter-related information and provide a digital signal to the third terminal that is regulated relative to a DC circuit common. The DC circuit common is electrically coupled to the second terminal and the digital signal is externally accessible between the second and third terminals. The series regulator is coupled to the first terminal and is adapted to conduct the load current and provide a first feedback output that is representative of the load current. The shunt is adapted to conduct a shunt current and provide a second feedback output that is representative of the shunt current. The loop current is substantially a summation of the load current and the shunt current. The shunt current regulator carries the shunt current and controls the loop current as a function of the first and second feedback outputs.

DETAILED DESCRIPTION OF THE PREFERRED EMBODIMENTS

Figure 2:
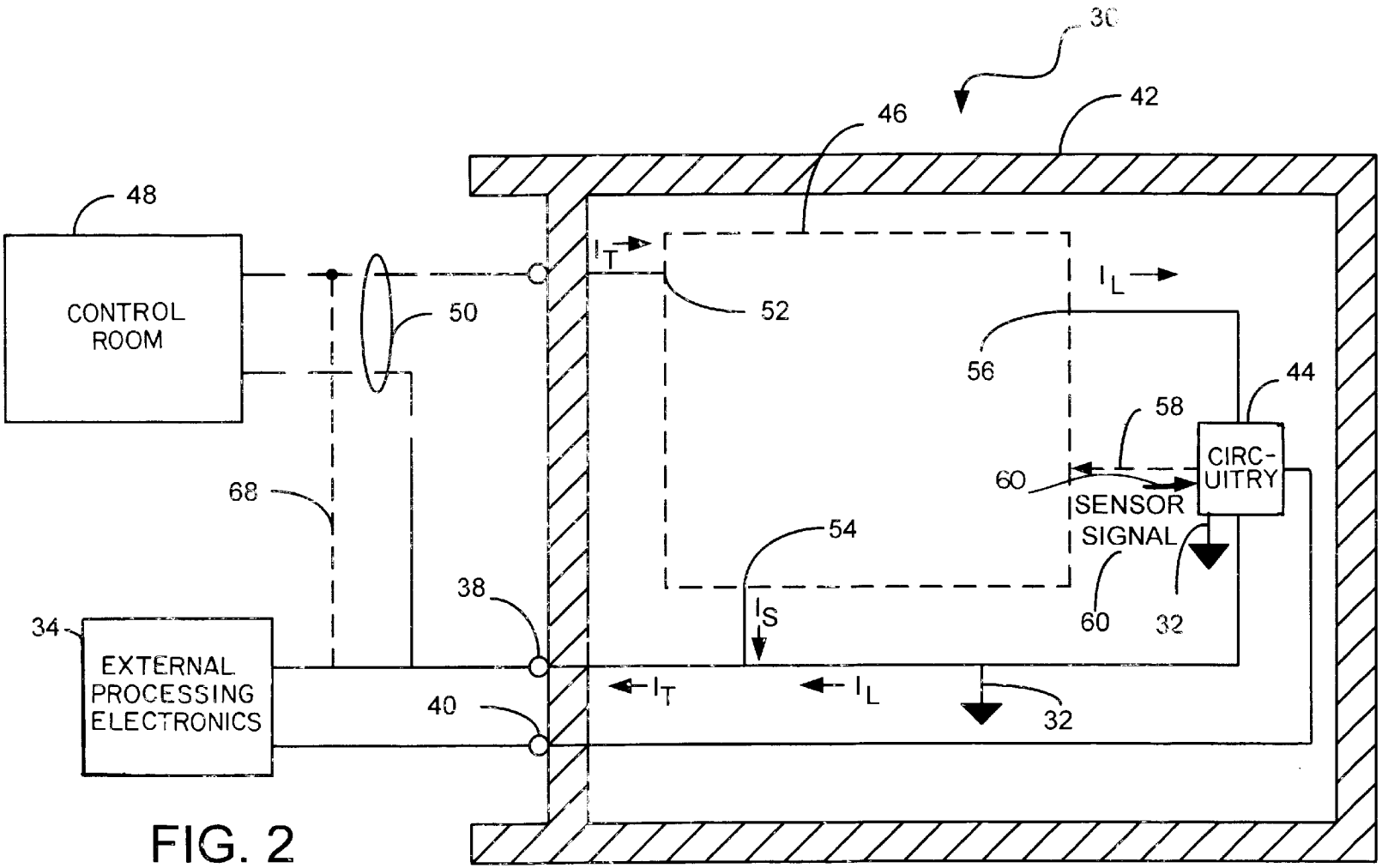
FIG. 2 shows a simplified block diagram of a process control transmitter, in accordance with the various embodiment of the invention.

FIG. 2 shows process control transmitter 30, which, in accordance with the general embodiments of the present invention, includes an externally accessible DC circuit common 32. This feature allows processing electronics 34, which are external to transmitter 30, to communicate with transmitter 30 using signals that are regulated relative to DC circuit common 32. As a result, transmitter 30 of the present invention can communicate with external processing electronics 34 without having to perform level shifting of the transmitted signals as would be required if the prior art current regulating circuits were used.

Transmitter 30 includes first, second, and third terminals 36, 38 and 40, respectively, which are preferably externally accessible and feed through hermetically sealed housing 42. Second terminal 38 is coupled to DC circuit common 32 to provide external access to DC circuit common 32. Transmitter 30 also includes circuitry 44 and series-shunt regulator 46. First and second terminals 36 and 38 are couplable to control room 48 through process control loop 50. Circuitry 44 is generally configured to communicate information to control room 48 over process control loop 50 using loop current $I_T$. This information can include process variable information, control signals, and information relating to the settings of transmitter 30. For example, process control loop 50 can be an analog loop, using a standard 4–20 mA analog signal, or a digital loop, which produces a digital signal in accordance with a digital communication protocol such as FOUNDATION™ fieldbus, Controller Area Network (CAN), or profibus, or a combination loop, where a digital signal is superimposed upon an analog signal, such as with the Highway Addressable Remote Transducer (HART®). Additionally, transmitter 30 can be a low power process control transmitter, which is completely powered by energy received over process control loop 50.

Figure 1:
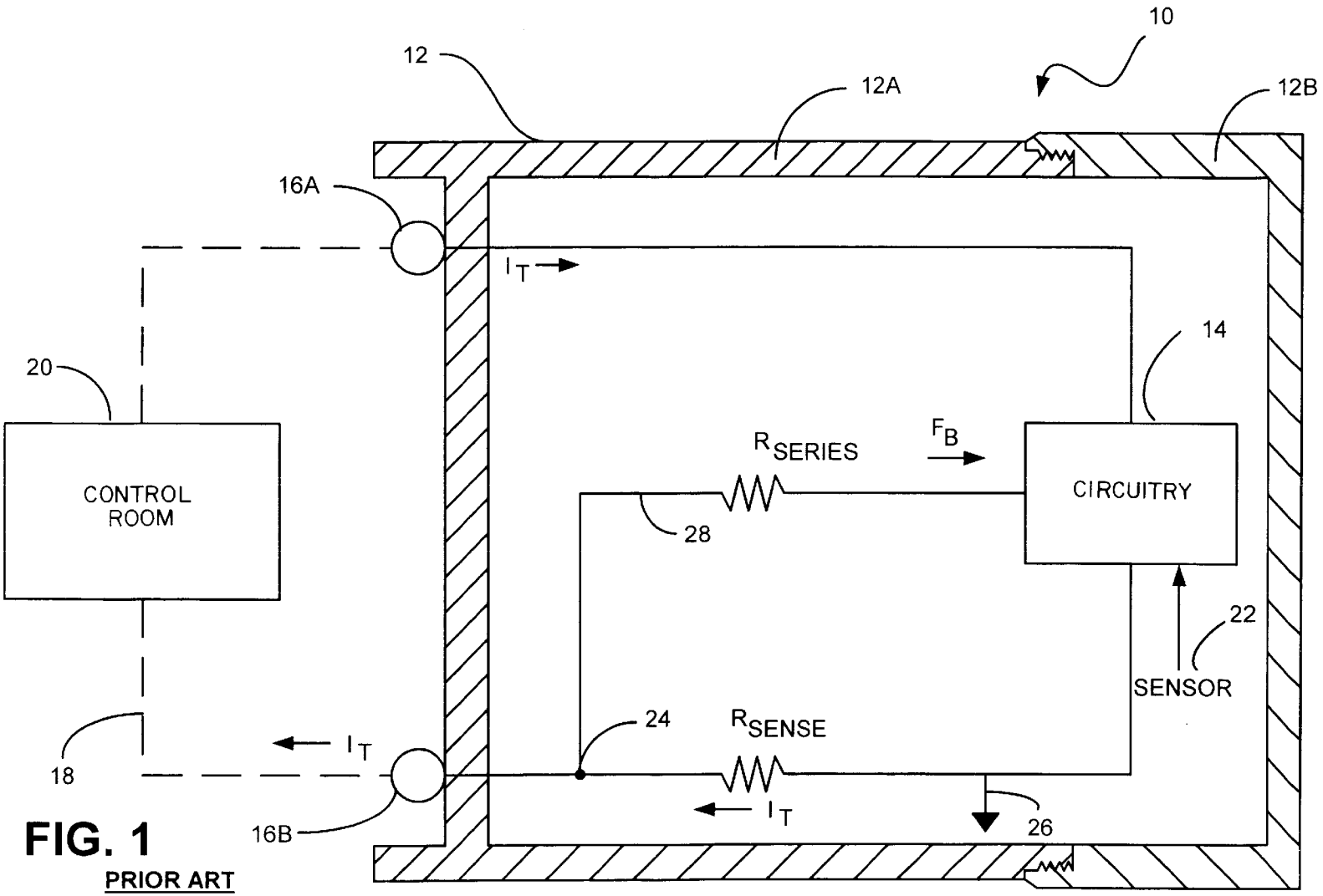
FIG. 1 PRIOR ART
FIG. 1 shows a simplified block diagram of a process control transmitter as can be found in the prior art.

Series-shunt regulator 46 is generally configured to control loop current $I_T$ flowing through transmitter 30. Unlike the current regulators of the prior art (FIG. 1), series-shunt regulator 46 allows loop current $I_T$ to flow out second terminal 38 that is at DC circuit common 32. Series-shunt regulator 46 includes input terminal 52 coupled to first terminal 36, shunt current output terminal 54 coupled to second terminal 38, and load current output terminal 56 coupled to circuitry 44. Series-shunt regulator 46 conducts load current $I_L$ which is used to energize circuitry 44 and shunt current $I_S$ that is used to control loop current $I_T$. Loop current $I_T$ is substantially the summation of load current $I_L$ and shunt current $I_S$. Series-shunt regulator 46 generally measures load current $I_L$ and applies shunt current $I_S$to shunt current output 54 to maintain loop current $I_T$ at a desired value.

In one embodiment of the invention, circuitry 44 provides series-shunt regulator 46 with a control signal, indicated by dashed line 58, that instructs series-shunt regulator 46 to set the loop current $I_T$ to a predetermined value. The predetermined value can relate to, for example, a sensor signal 60 that is provided to circuitry 44. Sensor signal 60 generally relates to a process variable. Although only a single sensor signal 60 is shown in FIG. 2, additional sensor signals can also be provided to circuitry 44 which can be used by circuitry 44 to compensate sensor signal 60 for errors relating to environmental conditions such as temperature. Series-shunt regulator 46 adjusts shunt current $I_S$ in response to the control signal 58 and load current $I_L$.

Figure 3:
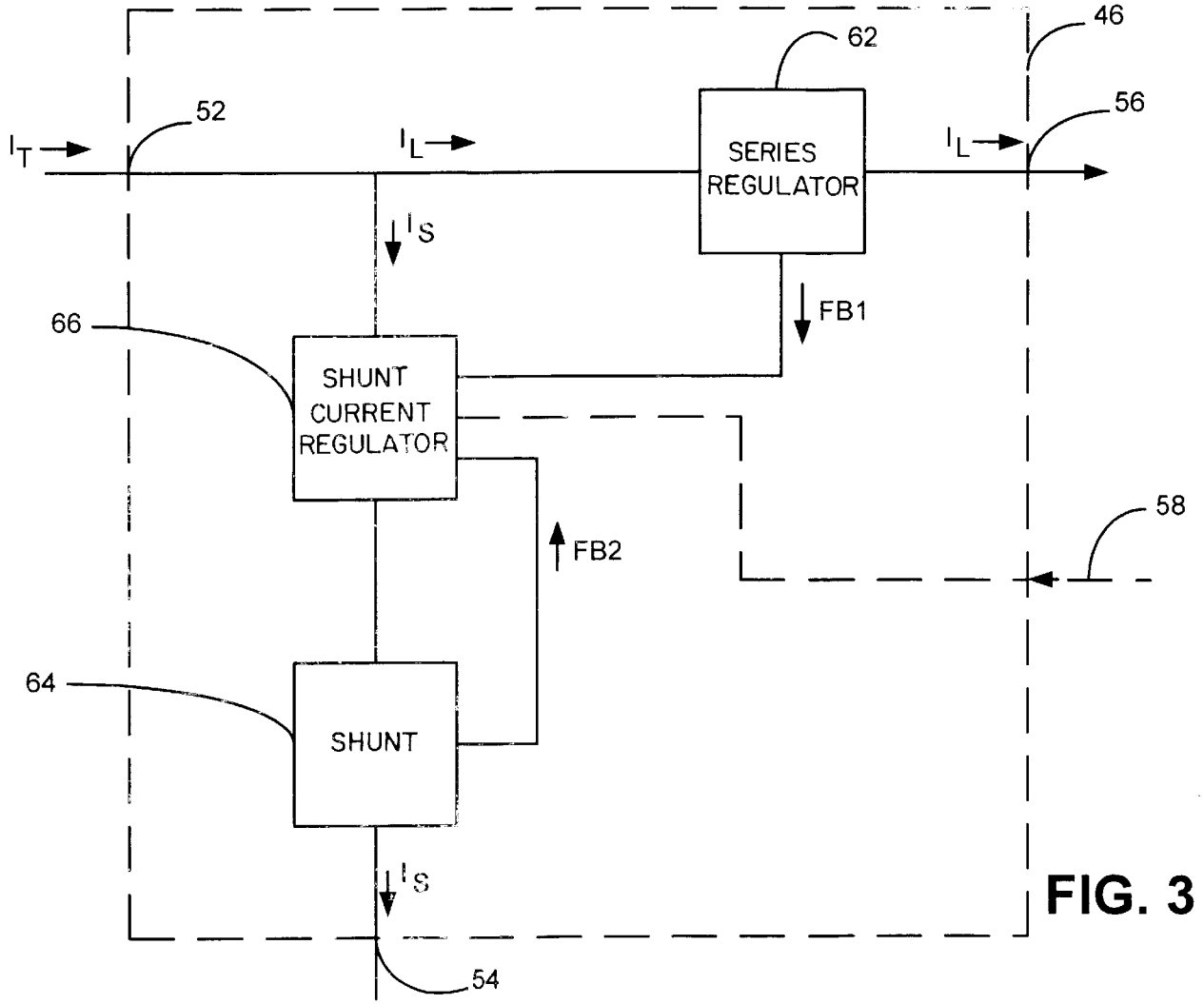
FIG. 3 shows a simplified block diagram of a series-shunt regulator, in accordance with one embodiment of the invention.

One embodiment of series-shunt regulator 46 is shown in FIG. 3. Here, series-shunt regulator 46 includes series regulator 62, shunt 64, and shunt current regulator 66. Load current $I_L$ is controlled by series regulator 62 and shunt 64 conducts shunt current $I_S$ which is controlled by shunt current regulator 66. Series regulator 62 couples to first terminal 36 through input terminal 52 and provides a first feedback output FB1 related to load current $I_L$. Shunt 64 conducts shunt current $I_S$ to shunt current output 54 and provides second feedback output FB2 related to shunt current $I_S$. Shunt current regulator 66 receives first and second feedback outputs FB1 and FB2 and controls loop current $I_T$ to a predetermined value as a function of first and second feedback outputs FB1 and FB2 by adjusting shunt current $I_S$. Control signal 58 can be received by shunt current regulator 66 to communicate a desired predetermined value.

Referring again to FIG. 2, circuitry 44 couples to third terminal 40, through which circuitry 44 can transmit and receive a digital signal. The digital signal is a voltage that is regulated relative to DC circuit common 32 that is coupled to second terminal 38. The digital signals can contain, for example, process variable information, transmitter setting information, and control information. Unlike the prior art, level shifting of the digital signal is not necessary due to the externally accessible DC circuit common 32 at second terminal 38, that is made possible by series-shunt regulator 46. As a result, one advantage to having DC circuit common 32 accessible at second terminal 38, is that transmitter 30 can couple to external processing electronics 34 at second and third terminals 38 and 40 and communicate digital signals between external processing electronics 34 and circuitry 44 without the need to perform level shifting of the digital signals and without the loss of noise margin. In one preferred embodiment of the invention, circuitry 44 is adapted to maintain third terminal 40 at a "high" logic voltage level, which can be used to power external processing electronics 34. Circuitry 44 is also preferably adapted to pull third terminal 40 to a "low" logic level, preferably to that of DC circuit common 32. The portion of load current $I_L$ that is delivered to third terminal 40 from circuitry 44 is indicated by first feedback output FB1 and taken into account by series-shunt regulator 46 so that loop current $I_T$ can be maintained at the desired level. Additionally, circuitry 44 prevents the back flow of current into third terminal 40 from external processing electronics 34 with diodes or other current blocking schemes. Consequently, process transmitter 30 can communicate with and power external processing electronics 34 while maintaining loop current $I_T$ at the desired level.

One embodiment of external processing electronics 34 is a liquid crystal display (LCD) that receives display information from circuitry 44 through third terminal 40. The LCD display could, for example, display process variable information relating to sensor signal 60. In one embodiment, the LCD display is powered by the output from circuitry 44 at third terminal 40. Here, the LCD display includes a capacitor to maintain the voltage level that is required to supply power to the LCD, even when third terminal 40 is pulled "low".

In another embodiment, external processing electronics 34 is an expansion module which can be coupled to second and third terminals 38 and 40, as discussed above, and also to first terminal 36 as indicated by dashed line 68, shown in FIG. 2. The expansion module is generally configured to expand the functionality of transmitter 30. For example, sensor signal 60 received by circuitry 44 of transmitter 30 could relate to a differential pressure measurement, which can be communicated to the expansion module as a digital signal that is regulated relative to DC circuit common 32 and is received by the expansion module through third terminal 40. The expansion module can use the received differential pressure measurement information to perform, for example, a mass flow calculation. Furthermore, the expansion module can be configured to communicate with control room 48 over process control loop 50. As a result, the expansion module can instruct circuitry 44 of transmitter 30 to disable its communications over process control loop 50. Additionally, the expansion module can increase the functionality of transmitter 30 by being configured to communicate with control room 48 using a communication protocol that transmitter 30 is not adapted to use. Also, since transmitter 30 is no longer directly communicating with control room 48 over process control loop 50, the expansion module can instruct circuitry 44 to disable shunt current regulator 66 such that, shunt current $I_S$ is approximately zero.

Figure 4:
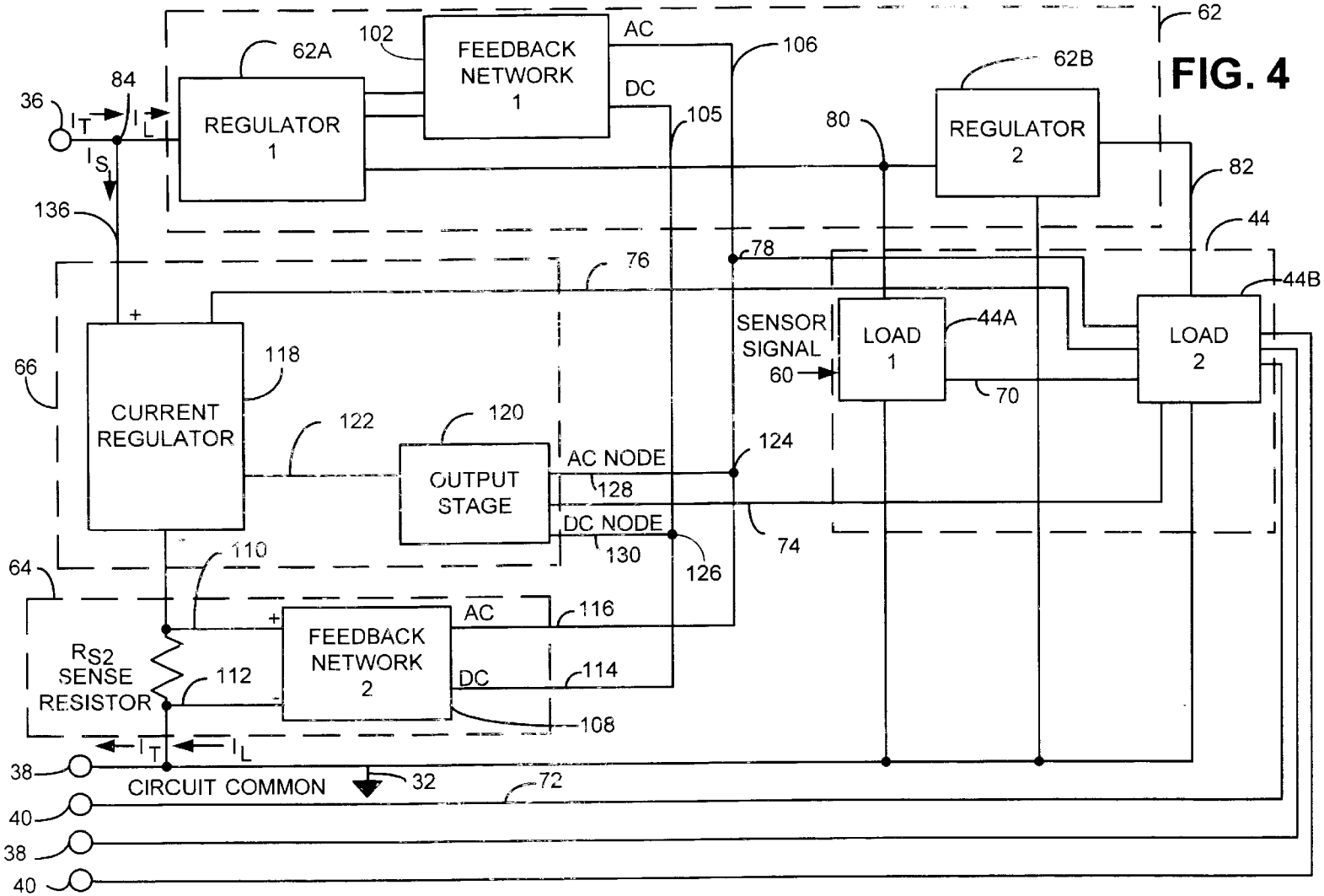
FIG. 4 shows a simplified block diagram of a process control transmitter, in accordance with the various embodiment of the invention.

Referring now to FIG. 4, the various embodiments of transmitter 30 will be discussed in greater detail. In one embodiment, circuitry 44 includes higher voltage, generally analog circuitry 44A and lower voltage, generally digital circuitry 44B. Analog circuitry 44A couples to digital circuitry 44B through conductor 70 through which analog circuitry 44A can provide digital circuitry 44B with an output signal that is related to sensor signal 60. Digital circuitry 44B can provide third terminal 40 with a digital signal over conductor 72. In another embodiment, digital circuitry 44B can provide shunt current regulator 66 with a signal that is indicative of sensor signal 60 through conductor 74. Finally, digital circuitry 44B can be configured to send and receive digital signals in accordance with the HART® communication protocol over conductors 76 and 78, respectively.

Series voltage regulator 62 includes higher voltage regulator 62A which energizes generally analog circuitry 44A and lower voltage regulator 62B which energizes generally digital circuitry 44B. Load current $I_L$, received by voltage regulator 62 at node 84, is thus divided between analog circuitry 44A and digital circuitry 44B. Analog circuitry 44A couples to higher voltage regulator 62A at node 80, which is preferably maintained by higher voltage regulator 62A at the voltage required by analog circuitry 44A to operate. In one embodiment, higher voltage regulator 62A maintains node 80 at 4.3 V. Digital circuitry 44B couples to lower voltage regulator 62B and DC circuit common 32. Lower voltage regulator 62B can receive power from higher voltage regulator 62A as indicated by the connection to node 80. Digital circuitry 44B is energized by lower voltage regulator 62B through conductor 82. In one embodiment, lower voltage regulator 62B maintains conductor 82 at 3.0 V.

Figure 5:
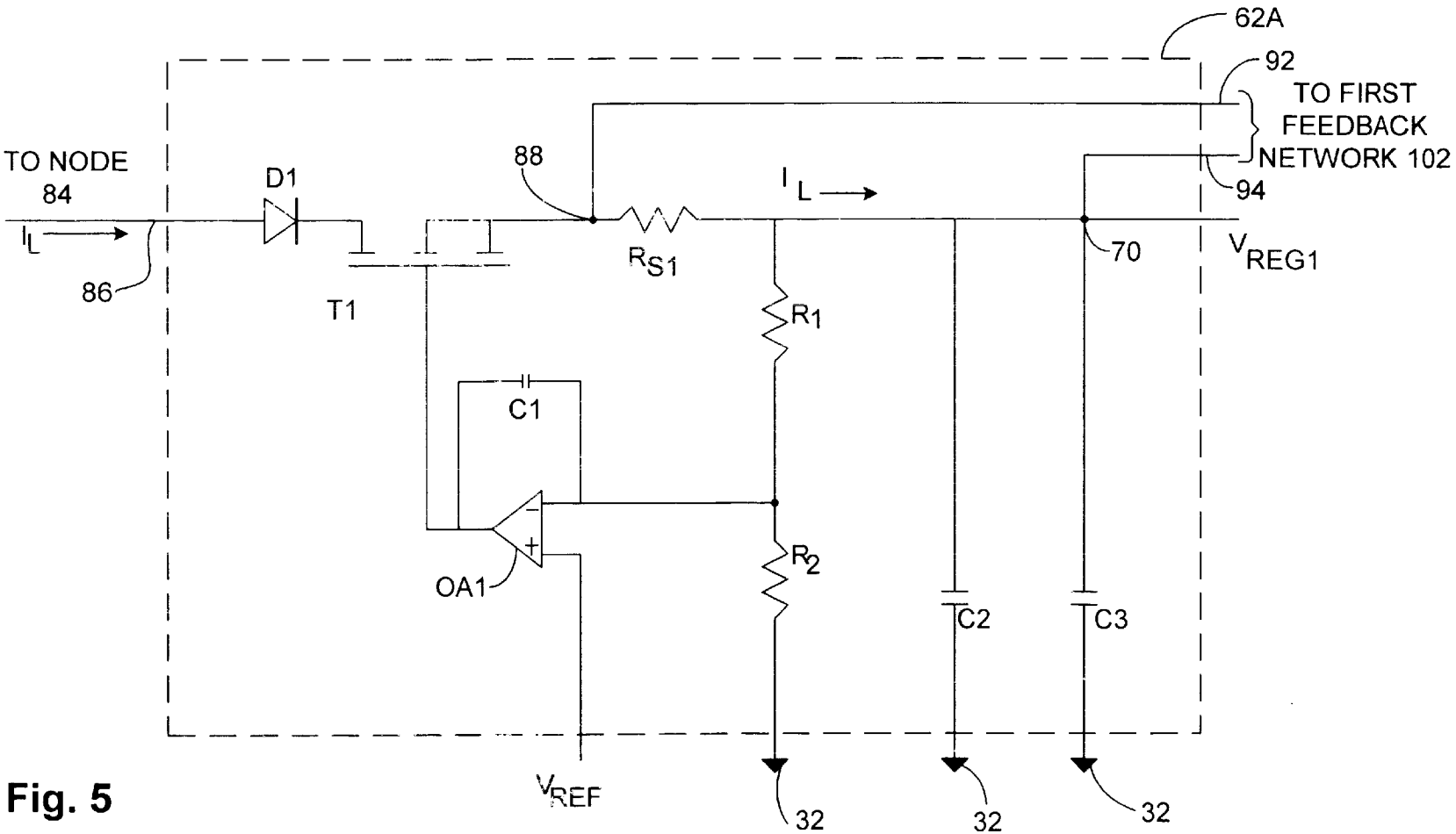
FIGS. 5 and 6 show simplified schematics of voltage regulators, in accordance with various embodiments of the invention.

FIG. 5 shows a simplified schematic of higher voltage regulator 62A. Higher voltage regulator 62A couples to node 84 through conductor 86. Load current $I_L$ flows through diode D1, which prevents load current $I_L$ from flowing back into node 84 in the event of a polarity reversal or a power interruption. Higher voltage regulator 62A is generally a series pass voltage regulator that includes an integrating comparator formed of operational amplifier (op-amp) OA1, capacitor C1, and resistors R1 and R2. Op-amp OA1 compares reference voltage $V_{REF}$, coupled to the positive input, to the voltage at the junction of resistors R1 and R2. Reference voltage $V_{REF}$ is generally set to a percentage of the voltage that is desired at node 90 or regulated voltage $V_{REG1}$. The percentage is set by resistors R1 and R2, which form a voltage divider. The output from op-amp OA1 controls transistor T1, depicted as an n-channel Depletion Mode MOSFET. Power supply bypass capacitors C2 and C3 limit the fluctuations of regulated voltage $V_{REG1}$. Sense resistor $R_{S1}$ is used to sense load current $I_L$. The voltage across sense resistor $R_{S1}$ can be accessed at nodes 88 and 90 through conductors 92 and 94, respectively. In one embodiment, higher voltage regulator 62A maintains $V_{REG1}$ at 4.3 V. The integrating comparator is tied to DC circuit common 32 through resistor $R_2$. Power supply bypass capacitors C2 and C3 are also tied to DC circuit common 32. Zener diode clamps (not shown) could be coupled between node 90 and DC circuit common 32 to meet intrinsic safety requirements. Those skilled in the art understand that many different configurations of higher voltage regulator 62A are possible which operate to produce a stable regulated voltage $V_{REG1}$ that can be used by circuitry 44, such as analog circuitry 44A.

Figure 6:
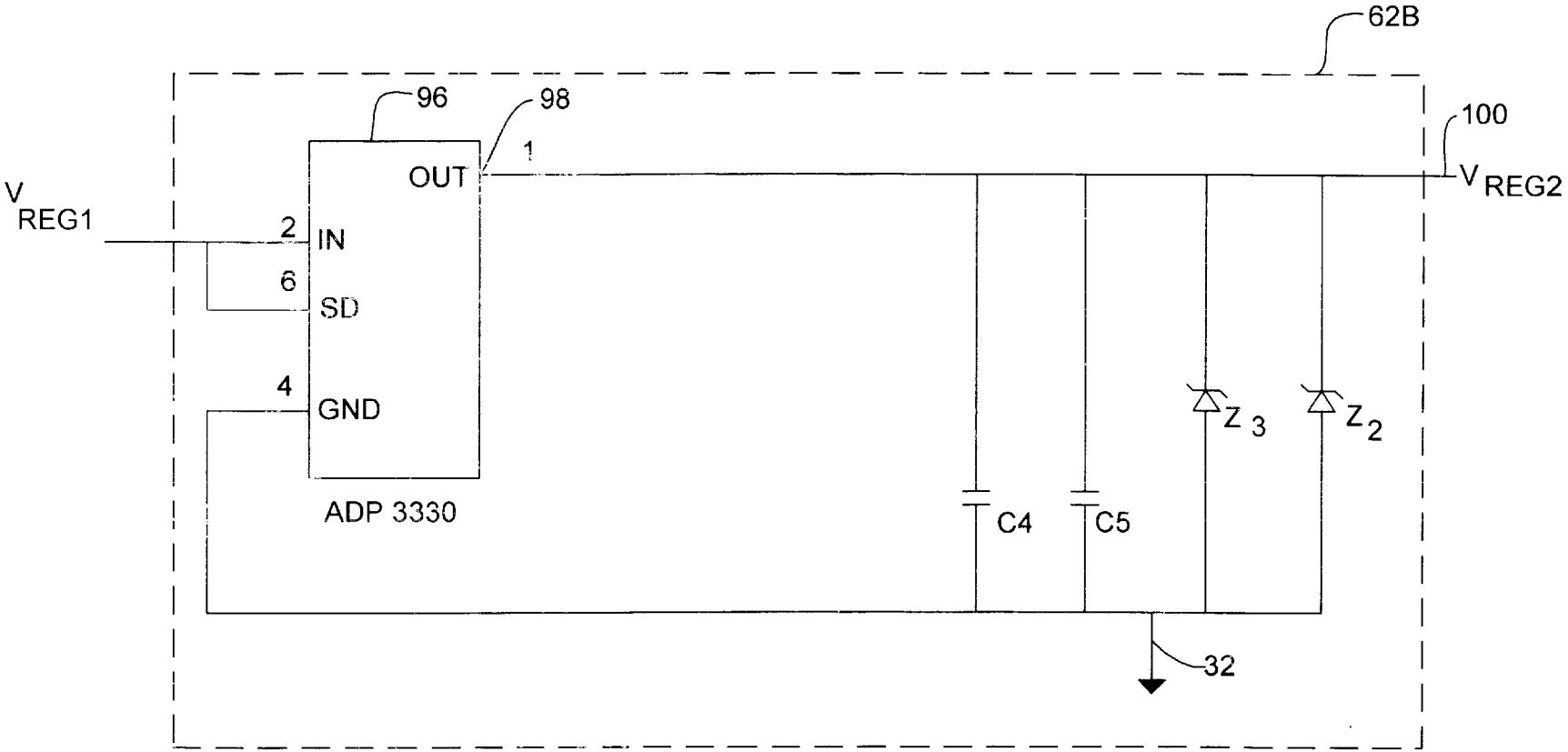

Referring now to FIG. 6, an embodiment of lower voltage regulator 62B is shown. Lower voltage regulator 62B receives regulated voltage $V_{REG1}$ from higher voltage regulator 62A at integrated circuit 96. Integrated circuit 96 is configured to produce a regulated voltage $V_{REG2}$ at output 98 in response to the input of regulated voltage $V_{REG1}$. One such suitable integrated circuit is the ADP 3330 integrated circuit manufactured by Analog Devices, Incorporated. Power supply bypass capacitors C4 and C5 operate to reduce fluctuations in regulated digital voltage $V_{DREG}$. Zener Diodes $Z_1$ and $Z_2$ are configured to limit the voltage drop between conductor 100 and DC circuit common 32 under fault conditions, such that lower voltage regulator 62B complies with intrinsic safety standards. In one embodiment, zener diodes $Z_1$ and $Z_2$ are 5.6 V zener diodes.

Figure 7:
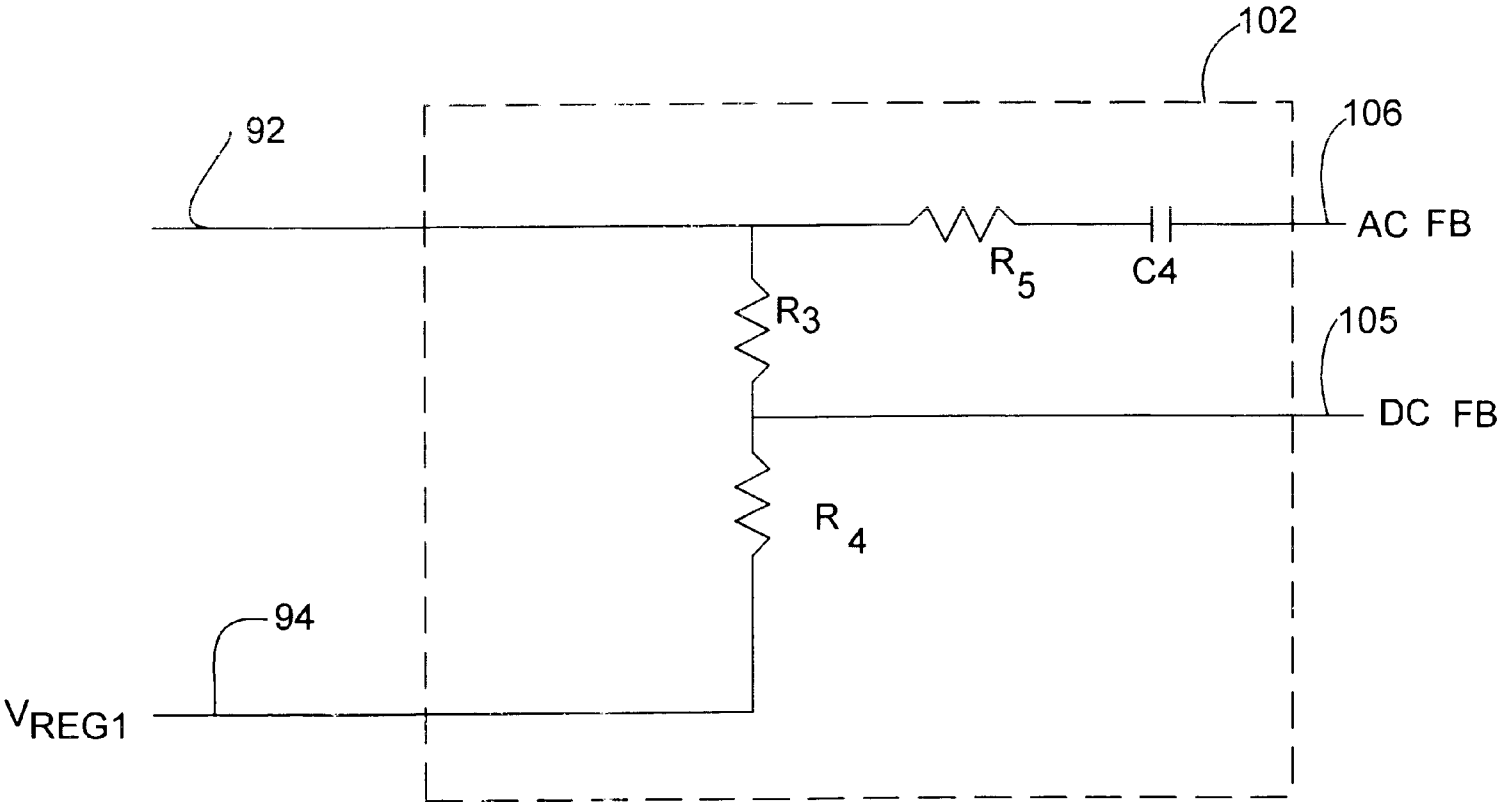
FIG. 7 shows a simplified schematic of a first feedback network, in accordance with one embodiment of the invention.

Voltage regulator 62 can also include feedback network 102 (FIG. 4) which is adapted to provide shunt current regulator 66 with first current feedback FB1, as shown in FIG. 3. In one embodiment, first feedback network 102 provides a feedback signal that is related to the DC component of load current $I_L$. FIG. 4 shows another embodiment, where first feedback network 102 provides feedback to shunt current regulator 66 relating to the AC and DC components of load current $I_L$. One possible configuration for first feedback network 102 is shown in FIG. 7. Here, first feedback network 102 can provide a DC feedback relating to the DC component of load current $I_L$ through conductor 105 which couples between resistors R3 and R4 of a voltage divider located between conductors 92 and 94. In addition, an AC feedback output can be provided through conductor 106 that relates to the AC component of load current $I_L$ Resistor R5 and capacitor C4 form a DC blocking circuit which allows only the AC components representing load current $I_L$ to pass.

Figure 8:
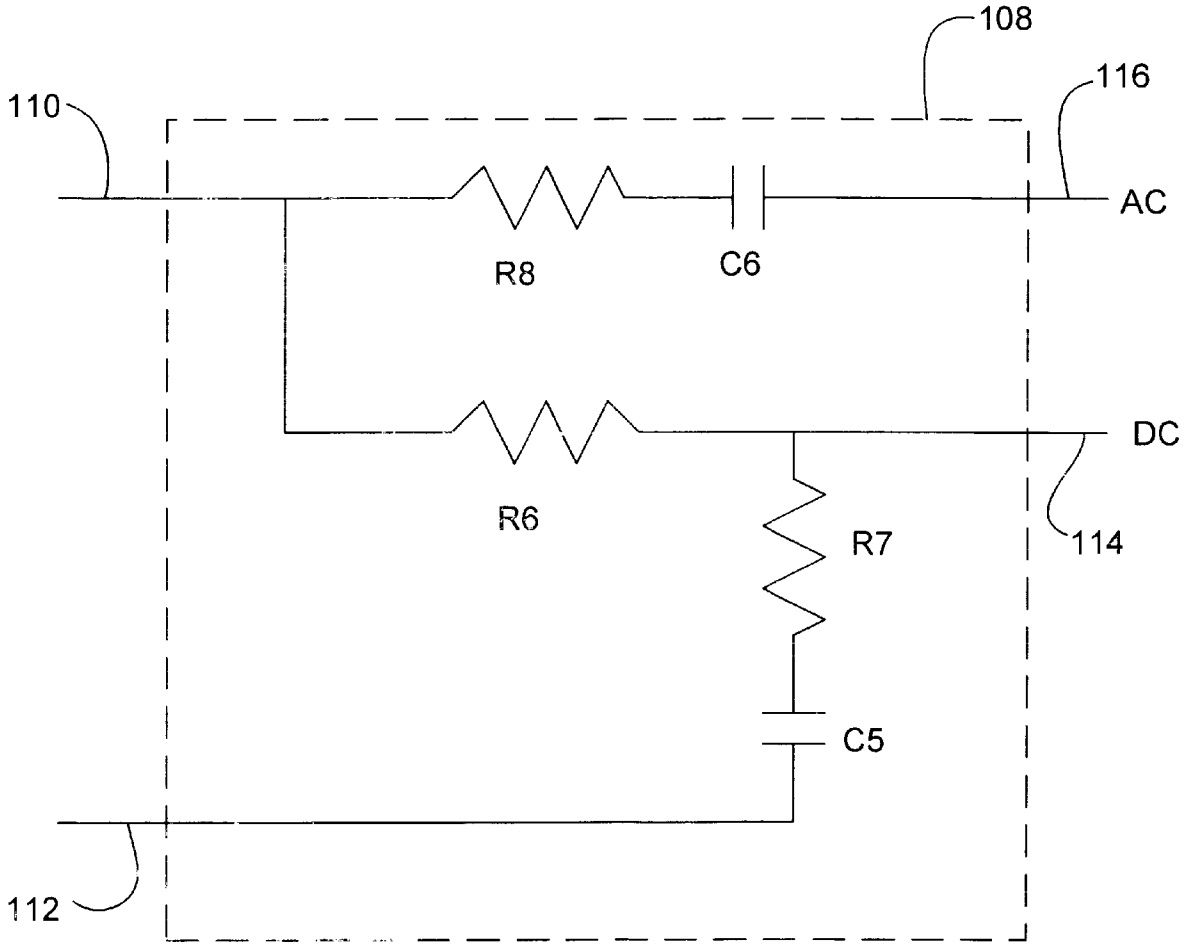
FIG. 8 shows a simplified schematic of a second feedback network, in accordance with one embodiment of the invention.

Shunt 64 includes second sense resistor $R_{S2}$ and second feedback network 108, as shown in FIG. 4. Second sense resistor $R_{S2}$ is positioned to sense shunt current $I_S$. Second feedback network 108 is adapted to produce second feedback output FB2 (shown in FIGS. 3 and 4) that is representative of shunt current $I_S$. In one embodiment, second feedback output FB2 is related to the DC component of shunt current $I_S$. In another embodiment, second feedback output FB2 includes AC and DC components relating to the AC and DC components of shunt current $I_S$, as indicated in FIG. 4. FIG. 8 shows one possible configuration for second feedback network 108, which measures the voltage drop across second sense resistor $R_{S2}$ through conductors 110 and 112. The DC component of second feedback output FB2 is produced at conductor 114 and the AC component of second feedback output FB2 is produced at conductor 116. Resistor R6, coupled between conductors 110 and 114, generally has a large resistance which reduces the flow of current through conductor 114 such that shunt current $I_S$ substantially flows through only second sense resistor $R_{S2}$. Resistor R7 and capacitor C5 act to filter the AC component of second feedback output FB2 that passes through resistor R6 to conductor 112 while blocking the DC component of second feedback output FB2 from flowing to conductor 112. As a result, only the DC component of second feedback output is allowed to pass along conductor 114. Resistor R8 and capacitor C6 form a DC blocking circuit that allows the AC component of second feedback output FB2 to pass from conductor 110 to conductor 116. Thus, only the AC component of second feedback output FB2 passes through conductor 116.

One embodiment of shunt current regulator 66 includes a current regulator 118 and output stage 120, as shown in FIG. 4. Output stage 120 is generally configured to provide a control signal in response to first and second feedback outputs received from first feedback network 102 and second feedback network 108, respectively. The control signal is provided to current regulator 118 over conductor 122. Current regulator 118 adjusts shunt current $I_S$ to set loop current $I_T$ to a certain value in response to the control signal. In this manner, output stage 120 controls current regulator 118 to adjust shunt current $I_S$ such that loop current $I_T$ is adjusted to a predetermined value. The predetermined value could relate to a signal received from circuitry 44, such as digital circuitry 44B, over conductor 74. The AC components of first and second feedback outputs FB1 and FB2 can be summed at node 124. Similarly, the DC components of first and second feedback outputs FB1 and FB2 can be summed at node 126. AC and DC components of first and second feedback outputs are received by output stage 120 over conductors 128 and 130, respectively.

Figure 9:
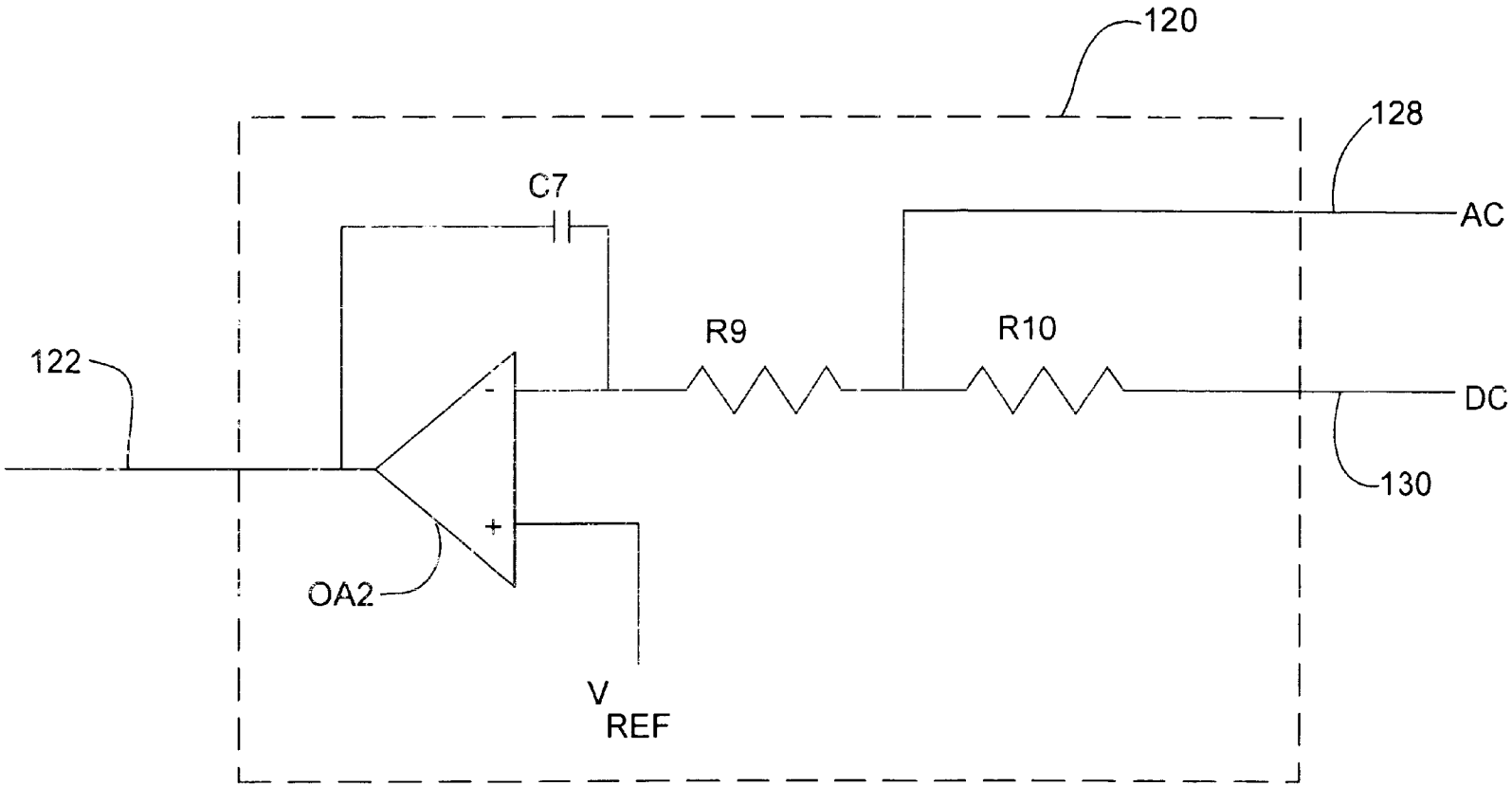
FIG. 9 shows a simplified schematic of an output stage, in accordance with one embodiment of the invention.

One possible configuration for output stage 120 is depicted in FIG. 9. Here, the DC components of first and second feedback outputs FB1 and FB2 pass through resistors R9 and R10 to the integrating comparator formed by op-amp OA2 and capacitor C7. The integrating comparator of output stage 120 compares the voltage at the negative input to a reference voltage VREF at the positive input. Op-amp OA2 produces an output signal on conductor 122 in response to the difference between the voltage at the negative input and the positive input of op-amp OA2. The AC components of first and second feedback outputs are allowed to pass through resistor R9 and capacitor C7 and are added to the output from op-amp OA2 at conductor 122. Thus, output stage 120 produces a control signal in response to first and second feedback outputs FB1 and FB2, that can be provided to current regulator 118 through conductor 122.

Figure 10:
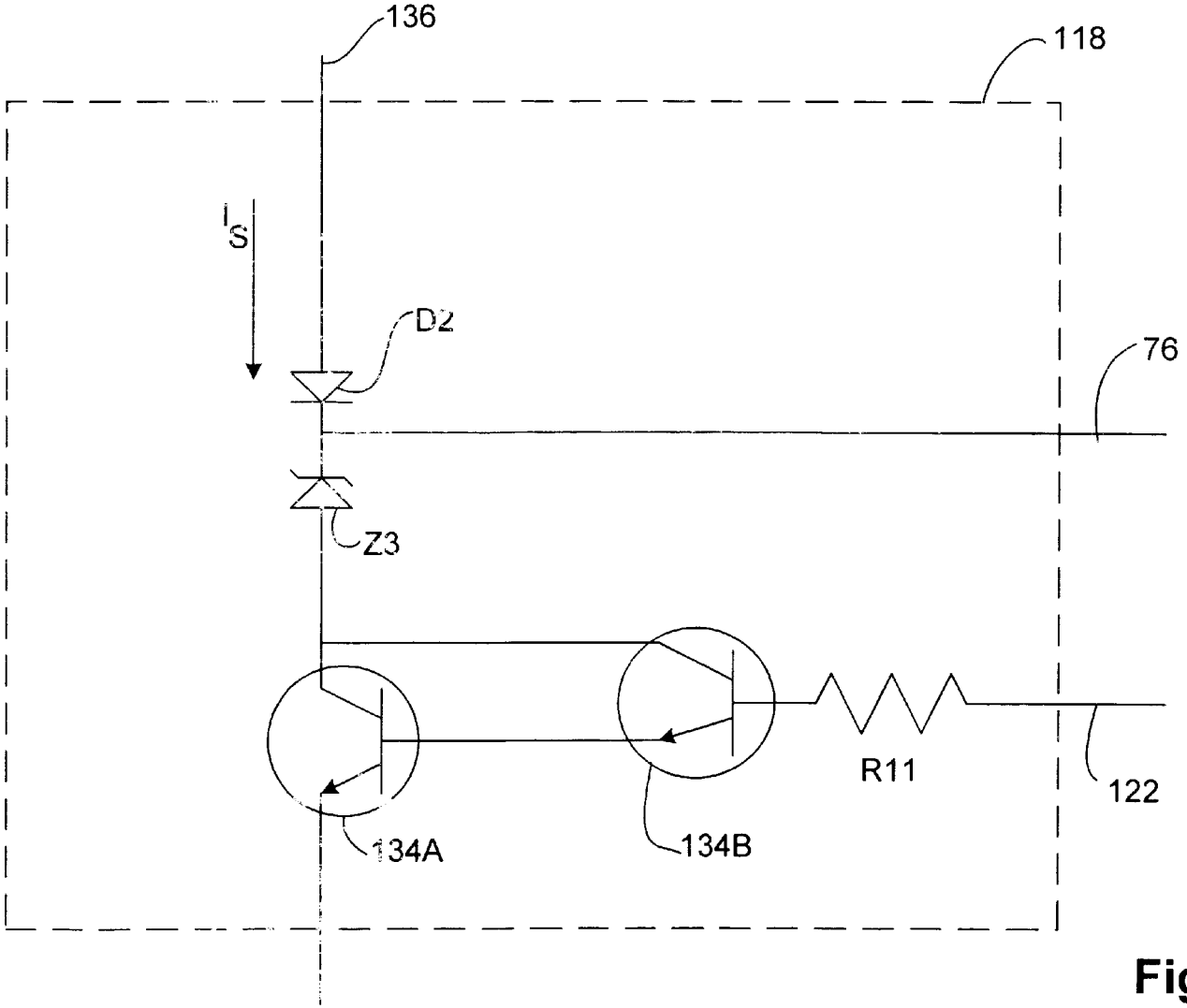
FIG. 10 shows a simplified schematic of a current regulator, in accordance with one embodiment of the invention.

As mentioned above, current regulator 118 controls the flow of shunt current $I_S$. One possible configuration for current regulator 118 utilizes a Darlington circuit formed by compound transistors 134A and 134B, as shown in FIG. 10. The control signal from output stage 120 is received by the Darlington circuit at transistor 134B through resistor R11. The Darlington circuit controls the flow of shunt current $I_S$ flowing through shunt 136 in response to the control signal received from output stage 120 through resistor R11. Diode D2 is placed in series with shunt 136 to prevent the backflow of current in the event of a polarity reversal or power interruption. Zener diode Z3 can also be placed in series with shunt 136 to further ensure that no shunt current $I_S$ flows when connected to an expansion module.

Referring again to FIG. 4, transmitter 30 can also include fourth and fifth terminals 138 and 140, respectively, which are externally accessible and couple to circuitry 44. In one embodiment, fourth and fifth terminals 138 and 140 couple to digital circuitry 44B and provide logic level switching for transmitter 30.

Although the present invention has been described with reference to preferred embodiments, workers skilled in the art will recognize that changes may be made in form and detail without departing from the spirit and scope of the invention. For example, the present invention, as described above, is generally designed to operate with first terminal 36 having a positive voltage relative to second terminal 38. However, those skilled in the art understand that modifications to the present invention can be made to configure the invention to operate with first terminal 36 having a polarity that is negative relative to second terminal 38. Additionally, those skilled in the art understand that many different configurations are possible for many of the components described above. The appended claims are therefore intended to cover all such changes and modifications as fall within the true spirit and scope of the invention.

What is claimed is:

1. A process control transmitter having an externally accessible DC common, comprising:

first, second and third externally accessible feedthrough terminals, wherein the first and second terminals are couplable to a process control loop and adapted to conduct a loop current $I_T$ through the transmitter;

a series-shunt regulator having an input terminal coupled to the first terminal and a shunt current output terminal coupled to the second terminal, the series-shunt regulator conducting a load current $I_L$ and controlling the loop current $I_T$ by regulating a shunt current $I_S$ out the shunt current output terminal; and circuitry energized by the load current $I_L$ and adapted to control the loop current $I_T$ in response to a sensor signal and provide a digital signal to the third terminal that has a voltage that is regulated relative to a DC common of the circuitry that is coupled to the second terminal, whereby the digital signal is externally accessible between the second and third terminals.

2. The process control transmitter of claim 1, wherein the series-shunt regulator comprises:

a series regulator coupled to the input terminal and adapted to conduct the load current $I_L$ and provide a first feedback output representative of the load current;

a shunt adapted to conduct the shunt current $I_S$ to the shunt current output terminal and provide a second feedback output representative of the shunt current $I_S$, wherein the loop current $I_T$ is substantially a summation of the load current $I_L$ and the shunt current $I_S$; and a shunt current regulator carrying the shunt current $I_S$ and adapted to control the loop current $I_T$ to a predetermined value as a function of the first and second feedback outputs.

3. The process control transmitter of claim 1, wherein the transmitter is completely powered by the process control loop.

4. The process control transmitter of claim 1, wherein the digital signal is in accordance with a digital communication protocol.

5. The process control transmitter of claim 1, wherein:

the circuitry includes a process variable output coupled to the shunt current regulator; and the series-shunt regulator is further adapted to control the loop current as a function of the process variable output, whereby the predetermined value relates to the process variable output.

6. The process control transmitter of claim 1, wherein the circuitry is configured to communicate with externally located processing electronics over the process control loop, in accordance with a communication protocol, using the series-shunt regulator.

7. The process control transmitter of claim 6, wherein the communication protocol is a digital communication protocol.

8. The process control transmitter of claim 2, wherein the first and second feedback outputs relate to DC components of the load and shunt currents, respectively.

9. The process control transmitter of claim 2, wherein the first and second feedback outputs relate to AC and DC components of the load and shunt currents, respectively.

10. The process control transmitter of claim 1, further comprising at least one of a fourth and fifth terminal adapted to provide logic level switching for the transmitter, wherein the fourth and fifth terminals are externally accessible feedthrough terminals.

11. A process control transmitter comprising:

first, second and third externally accessible feedthrough terminals, wherein the first and second terminals are couplable to a process control loop and adapted to conduct a loop current $I_T$ through the transmitter;

a base module including:

a series-shunt regulator having an input terminal coupled to the first terminal and a shunt current output terminal coupled to the second terminal, the series-shunt regulator conducting a load current $I_L$ and controlling the loop current $I_T$ by regulating a shunt current $I_S$ out the shunt current output terminal; and circuitry energized by the load current $I_L$ and adapted to receive a sensor signal and provide a digital signal to the third terminal that has a voltage that is regulated relative to a DC common of the circuitry that is coupled to the second terminal, whereby the digital signal is externally accessible between the second and third terminals.

12. The process control transmitter of claim 11, wherein the series-shunt regulator comprises:

a series regulator coupled to the input terminal and adapted to conduct the load current $I_L$ and provide a first feedback output representative of the load current;

a shunt adapted to conduct the shunt current $I_S$ to the shunt current output terminal and provide a second feedback output representative of the shunt current $I_S$, wherein the loop current $I_T$ is substantially a summation of the load current $I_L$ and the shunt current $I_S$; and a shunt current regulator carrying the shunt current $I_S$ and adapted to control the loop current $I_T$ to a predetermined value as a function of the first and second feedback outputs.

13. The transmitter of claim 11, further comprising an expansion module couplable to the first, second, and third terminals, whereby the expansion module communicates with the circuitry of the base module through the second and third terminals.

14. The transmitter of claim 13, wherein the expansion module provides at least one feature selected from a group consisting of calculating mass flow rate and expanding communication capabilities.

15. The transmitter of claim 13, wherein the expansion module communicates with the base module through the second and third terminals in accordance with a digital communication protocol.

16. The transmitter of claim 11, wherein the third terminal is adapted to power and communicate information to, a liquid crystal display (LCD).

17. The process control transmitter of claim 11, wherein the transmitter is completely powered by the process control loop.

18. The process control transmitter of claim 11, wherein:

the circuitry includes a process variable output coupled to the shunt current regulator; and the series-shunt regulator is further adapted to control the loop current as a function of the process variable output, whereby the predetermined value relates to the process variable output.

19. The process control transmitter of claim 11, wherein the circuitry is configured to communicate with externally located processing electronics over the process control loop, in accordance with a communication protocol, using the series-shunt regulator.

20. The process control transmitter of claim 19, wherein the communication protocol is a digital communication protocol.

21. The process control transmitter of claim 12, wherein the first and second feedback outputs relate to DC components of the load and shunt currents, respectively.

22. The process control transmitter of claim 12, wherein the first and second feedback outputs relate to AC and DC components of the load and shunt currents, respectively.

23. The process control transmitter of claim 11, further comprising at least one of a fourth and fifth terminal adapted to provide logic level switching for the transmitter, wherein the fourth and fifth terminals are externally accessible feedthrough terminals.

24. A method of manufacturing a process control transmitter, comprising:

forming first, second and third terminals which feedthrough a housing, the first and second terminals being couplable to a process control loop and adapted to conduct a loop current $I_T$ through the transmitter and the third terminal;

installing a series-shunt regulator in the housing having an input terminal coupled to the first terminal and a shunt current output terminal coupled to the second terminal, the series-shunt regulator conducting a load current $I_L$ and controlling the loop current $I_T$ by regulating a shunt current $I_S$ out the shunt current output terminal; and installing circuitry in the housing that is energized by the load current $I_L$ and adapted to receive a sensor signal and provide a digital signal to the third terminal that has a voltage that is regulated relative to a DC common of the circuitry that is coupled to the second terminal, whereby the digital signal is externally accessible between the second and third terminals.

25. The method of claim 24, including powering the transmitter through the process control loop.

26. The method of claim 24, wherein the digital signal is in accordance with a digital communication protocol.

27. The method of claim 24, wherein the external processing electronics includes one of a liquid crystal display and an expansion module.

* * * * *

UNITED STATES PATENT AND TRADEMARK OFFICE

CERTIFICATE OF CORRECTION

PATENT NO. : 6,504,489 B1 Page 1 of 1
DATED : January 7, 2003
INVENTOR(S) : Westfield et al.

It is certified that error appears in the above-identified patent and that said Letters Patent is hereby corrected as shown below:

Title page,
Item [56], References Cited, FOREIGN PATENT DOCUMENTS, change
"DE 91 09 176 10/1991" to -- DE 91 09 176.4 10/1991 --.
OTHER PUBLICATIONS, change
"Product Data Sheet No.: 00813-0100-4773, "Model 8742C-Magnetic Flowmeter Transmitter with Foundation™ Fieldbus", from the Rosemount Comprehensive Product Catalog, published 1998, by Rosemount Inc., Eden Prairie, Minnesota." to
-- Product Data Sheet No.: 00813-0100-4773, "Model 8742C-Magnetic Flowmeter Transmitter with FOUNDATION™ Fieldbus", from the Rosemount Comprehensive Product Catalog, published 1998, by Rosemount Inc., Eden Prairie, Minnesota. --
"Technical Information Bullentin, "Liquid Level Transmitter Model DB40RL Sanitary Sensor deltapilot," Endress + Hauser, Greenwood, Indiana, 9/92, pp. 1-8." to
-- Technical Information Bullentin, "Liquid Level Transmitter Model DB40RL Sanitary Sensor deltapilot," Endress + Hauser, Greenwood, Indiana, 9/92, pp. 1-8. --
"2 pages downloaded from http://www.interlinkbt.com/PRODUCT/IBT_PROD/DN/CN-$DM_{13}$PN/EURO-DP.HTM dated Sept. 15, 2000." to -- 2 pages download from http://www.interlinkbt.com/PRODUCT/IBT_PROD/DN/CN-DM_PN/EURO-DP.HTM dated Sept. 15, 2000. --

Signed and Sealed this

Twenty-sixth Day of August, 2003

JAMES E. ROGAN
*Director of the United States Patent and Trademark Office*